US006923327B1

(12) United States Patent
Cohen

(10) Patent No.: US 6,923,327 B1
(45) Date of Patent: Aug. 2, 2005

(54) INJECTION MOLDED CONTAINER

(76) Inventor: Jeremy Cohen, 35 Powerhouse Rd., Roslyn Heights, NY (US) 11577

( * ) Notice: Subject to any disclaimer, the term of this patent is extended or adjusted under 35 U.S.C. 154(b) by 43 days.

(21) Appl. No.: 10/273,063

(22) Filed: Oct. 17, 2002

(51) Int. Cl.[7] ..... B65D 25/00
(52) U.S. Cl. ..... 206/765
(58) Field of Search ..... 206/764, 765, 206/758, 756, 560, 480, 483, 485, 4.23

(56) References Cited

U.S. PATENT DOCUMENTS

| | | | | |
|---|---|---|---|---|
| 2,625,292 | A | 1/1953 | Spender | |
| 3,727,749 | A * | 4/1973 | Martin | 206/366 |
| 4,119,204 | A * | 10/1978 | Peckar | 206/521 |
| 4,518,092 | A | 5/1985 | Contreras, Sr. | |
| 4,606,355 | A * | 8/1986 | Dammann | 460/69 |
| 4,881,639 | A * | 11/1989 | Matsuoka et al. | 206/724 |
| D310,968 | S | 10/1990 | Nordskog | |
| 5,004,106 | A | 4/1991 | Blumstock et al. | |
| D337,049 | S | 7/1993 | Morgan et al. | |
| 5,363,956 | A * | 11/1994 | Taniyama | 206/312 |
| D380,900 | S | 7/1997 | Pearson et al. | |
| 5,860,550 | A * | 1/1999 | Miller et al. | 120/4.23 |
| D406,057 | S | 2/1999 | Hager | |
| 5,931,299 | A * | 8/1999 | Hsieh | 206/376 |
| 6,047,826 | A * | 4/2000 | Kalinski et al. | 206/365 |
| 6,230,889 | B1 | 5/2001 | Chen | |

* cited by examiner

*Primary Examiner*—Lee Young
(74) *Attorney, Agent, or Firm*—Collard & Roe, P.C.

(57) ABSTRACT

An integrally injection molded container for merchandise, preferably bottles. The container has two shaped halves that are connected to each other by a living hinge. A closure fastener is disposed at an end of each half that is opposite the living hinge. The closure fastener secures the two shaped halves in a closed position along their outer rims. When in the closed position, an enclosed internal space is defined between the two halves. There is a set of upstanding walls disposed on an inner surface of one of the identical halves. These walls are molded to receive a bottle. Gripping projections are disposed at the ends of the upstanding walls. These gripping projections curve inwardly toward the area where the bottle is held. When the bottle is placed in this area it is releasably secured in place, preventing it from falling out of the container when the molded shaped halves are in an open position.

11 Claims, 3 Drawing Sheets

INJECTION MOLDED CONTAINER

BACKGROUND

The invention relates to a molded container adapted for holding merchandise, preferably a cologne or perfume bottle. The container is closed by a living hinge made from a flexible thermoplastic synthetic polymer composition and integrally formed with the rest of the container. The living hinge of the present invention like the containers known in the art relies on the characteristics of the thermoplastic synthetic polymer composition materials.

The container is utilized in retail for displaying the cologne or perfume and is also used as a carrying case. Conventional perfume or cologne containers typically only encase the bottle leading to breakage during transport or when the container is accidentally opened. The improved container secures a cologne or perfume bottle within the container when closed and holds the bottle in the container even when the container is opened.

SUMMARY

The invention relates to an injection molded container for merchandise, preferably bottles. The container is preferably integrally formed. The container has two shaped halves that are connected to each other by a living hinge. Each half is bowl shaped and has a rim. A fastener is disposed at an end of each half that is opposite the living hinge. The fastener secures the two shaped halves in a closed position along the rims. When in the closed position an enclosed internal space is defined between the two halves.

A set of upstanding walls are molded on an inner surface of one of the identical halves. These walls are shaped to receive the merchandise. Gripping projections are disposed at the ends of the upstanding walls. These gripping projections curve inwardly toward the area where the merchandise is held. When the merchandise is placed in this area it is releasably secured in place, preventing it from falling out of the container when the molded shaped halves are in an open position.

BRIEF DESCRIPTION OF THE DRAWINGS

Other objects and features of the present invention will become apparent from the following detailed description considered in connection with the accompanying drawings which disclose at least one embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION

Figure 1:
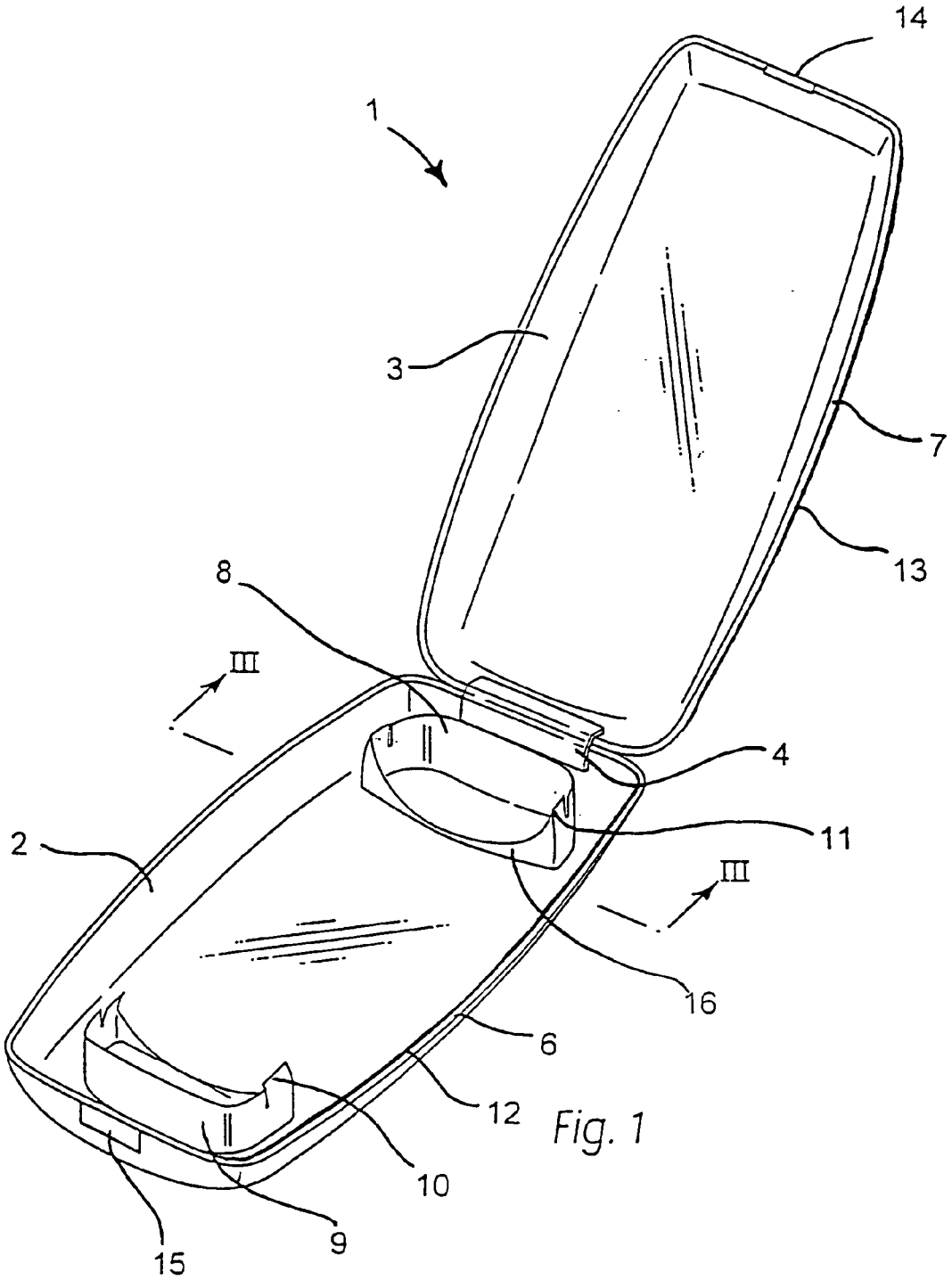
FIG. 1 shows a perspective view of the container in the open position.

FIG. 1 shows an injection molded container 1 for merchandise, preferably cologne or perfume bottles. Container 1 is preferably integrally formed. Container 1 has two shaped halves 2, 3, that are preferably identically shaped, and connected by a living hinge 4. Living hinge 4 permits shaped halves 2, 3 to open and close. A fastener, keeps shaped halves 2, 3 of container 1 in a closed position. The fastener has a locking extension 14 on one shaped half 3 that engages a receiving cavity 15 in the other shaped half 2. The fastener may be engaged by simply pushing locking extension 14 on top of receiving cavity 15. Once the fastener is engaged container 1 is in a secured closed position. To disengage the fastener, locking extension 14 is lifted slightly from receiving cavity 15 and shaped halves 2, 3 are separated. Alternate embodiments may not include living hinge 4 and two shaped halves may be fastened together.

In the closed position the rims 6, 7 of shaped halves 2, 3 meet and an enclosed interior space is created in container 1. Rims 6, 7 each have a lip 12, 13. One lip 12 is on an inner side of rim 6 while the other lip 13 is on the outer side of rim 7. Their placement permits them to engage and prevent shaped halves 2, 3 from sliding against one another while in the closed position.

Figure 2:
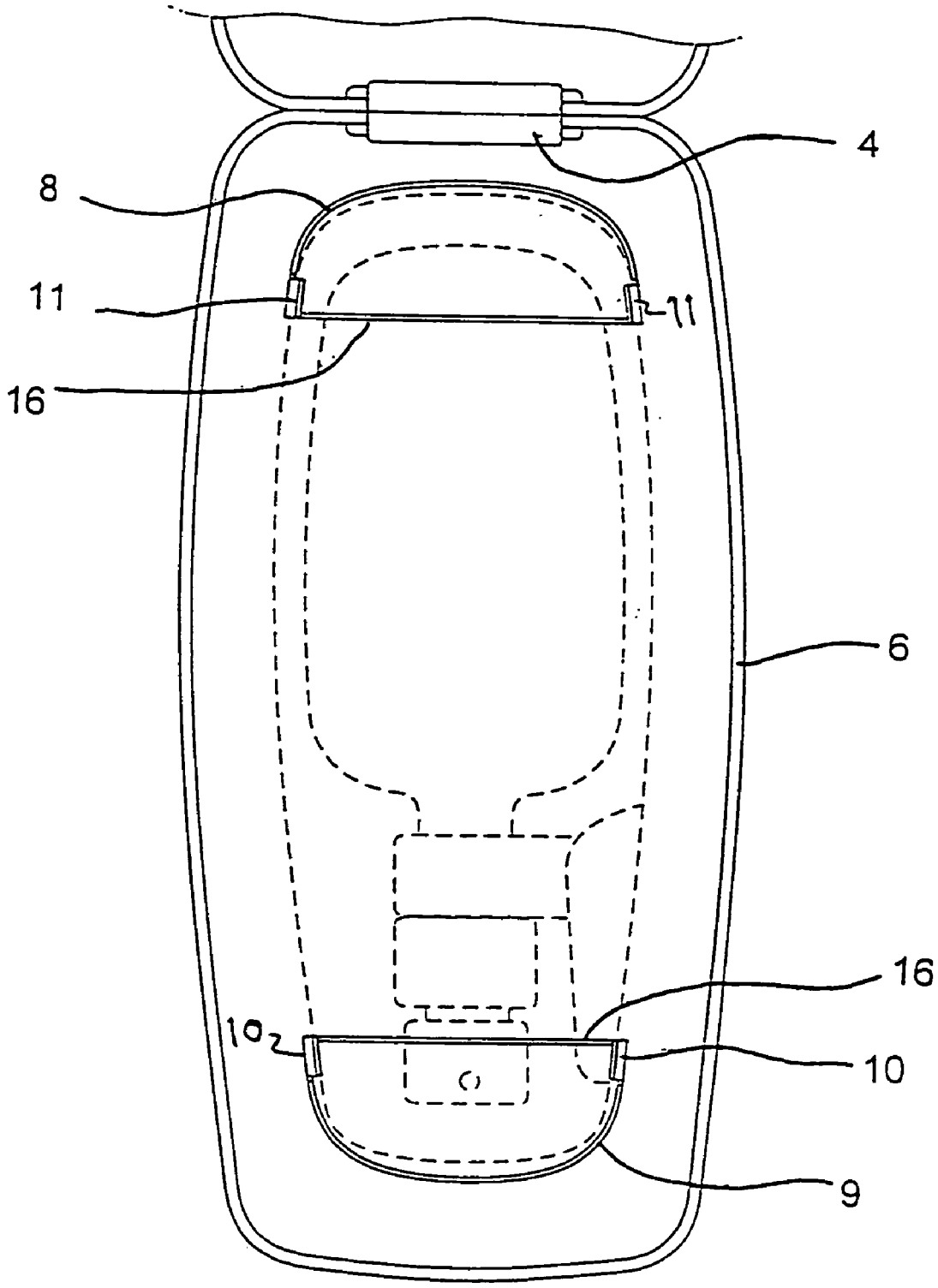
FIG. 2 shows a top view of the shaped bottom half of the container.

FIG. 2 shows a top view of the bottom shaped half. Shaped halves 2, 3 are preferably of a curved rectangular shape. Living hinge 4 is located on a shorter side of the curved rectangular shape while the fastener is located on the shorter side opposite living hinge 4. Rims 6, 7 and lips 12, 13 surround the entire perimeter edge of each shaped half 2, 3.

One of the shaped halves 2, has two upstanding walls 8, 9 on its inner surface. Upstanding walls 8, 9 are molded to surround and secure the top and bottom of a cologne or perfume bottle. In the present embodiment, upstanding walls 8, 9 have a curved shape identical to the top and bottom of the bottle. Each upstanding wall 8, 9 has two ends with a set of gripping projections 10, 11 extending from these ends.

Figure 3:
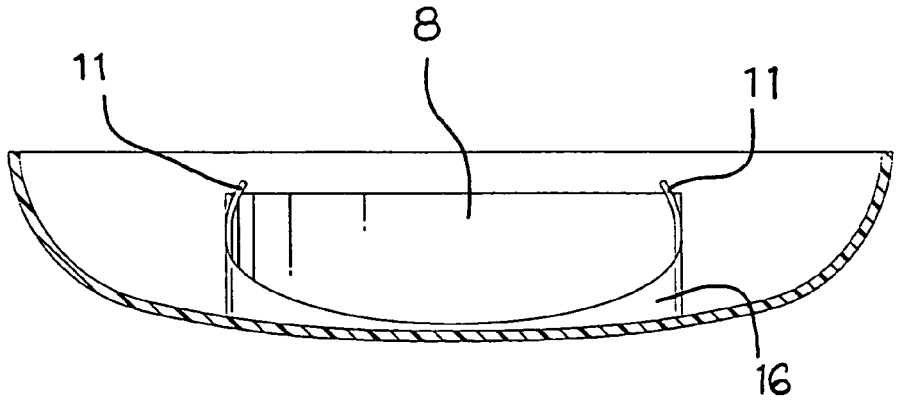
FIG. 3 shows a side view of the shaped bottom half of the container.
Figure 4:
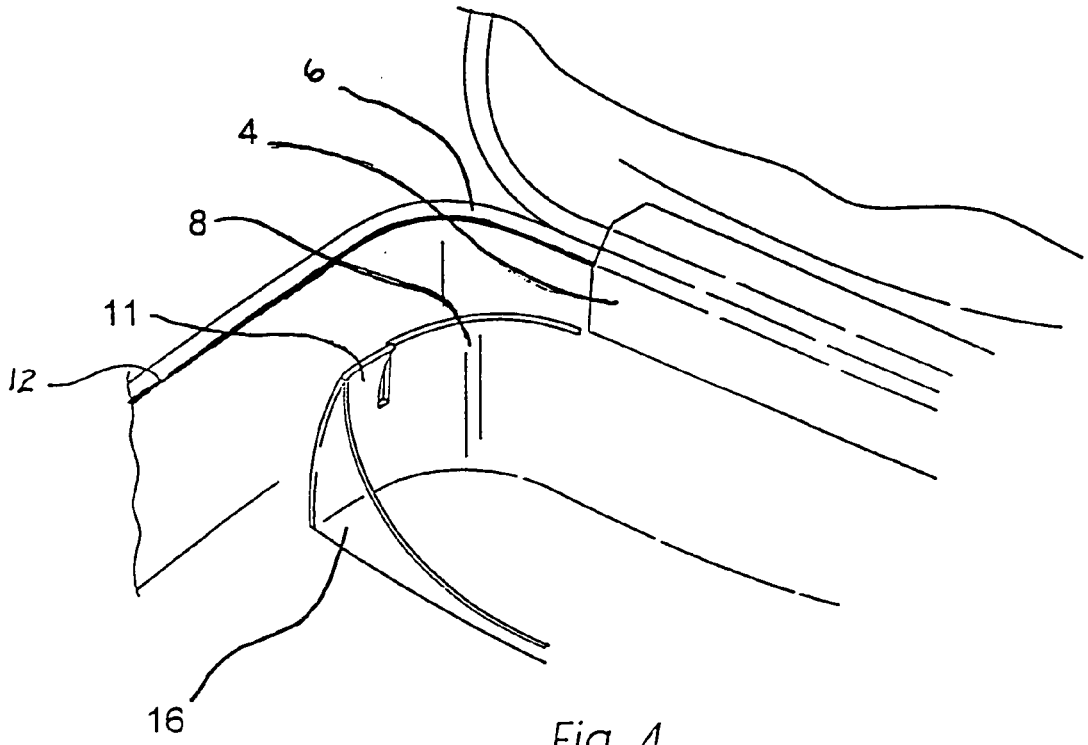
FIG. 4 shows a magnified view of the gripping projections of the upstanding wall.

FIG. 3 is a side view of the bottom shaped half and FIG. 4 shows a magnified view of gripping projections 10, 11. Both FIGS. demonstrate that gripping projections 10, 11 extend further out from the inner surface of shaped half 2 and curve inwardly toward the area where the bottle is secured. Upstanding walls 8, 9 and gripping projections 10, 11 hold the bottle in place and prevent it from falling out of container 1, even when container 1 is in the open position. The base of gripping projections 10, 11 is in communication with upstanding walls 8, 9 but the elements separate and gripping projections 10, 11 curve inwardly and away from upstanding wall 8, 9.

Gripping projections 10, 11 are molded to the shape of the bottle so that when the bottle is placed in container 1 it is cradled on the top and bottom by upstanding walls 8, 9 and around its sides by gripping projections 10, 11. Gripping projections 10, 11 are flexible and bend outwardly when the bottle is inserted between them. Once the bottle is inserted gripping projections retake their original shape, frictionally securing the bottle in a pinch-like fashion. In order to remove the bottle a force must be exerted on the bottle that causes gripping projections 10, 11 to bend outwardly. Gripping projections 10, 11 again take their original form once the bottle is removed. Thus, the bottle is secured by the frictional support of gripping projections 10, 11 and its insertion and removal is dependent upon the flexibility of gripping projections 10, 11.

An additional wall 16 connects gripping projections 10, 11 and its height varies depending on the shape of the bottle in the region of additional wall 16. This is demonstrated most clearly in FIG. 3. The bottle has a rounded front that lies on top of additional wall 16. Upstanding walls 8, 9 cradle the top and bottom of the bottle, while gripping projections 10, 11 frictionally hold the sides of the bottle in place on top of additional wall 16. Therefore, the bottle is securely cradled in the container. In a preferred embodiment, while secured, the bottle is minimally spaced from the shaped halves of the container in the closed position.

Additional embodiments may not require a fastener for the container or may fasten by engagements on rims 6, 7 of shaped halves 2, 3. Further, the container may only require one upstanding wall 8, 9 and one set of gripping projections 10, 11 if the bottle is inserted into a more rigid cradle, such as a cup, on the opposing end. The container is preferably made of a thermoplastic. The container may be used for any type of merchandise such as perfume or cologne bottles, cosmetics, cigarettes, etc.

Accordingly, while at least one embodiment of the present invention has been shown and described, it is to be understood that many changes and modifications may be made thereunto without departing from the spirit and scope of the invention as defined in the appended claims.

What is claimed is:

1. An injection molded, integrally-formed container for a bottle having a rounded shape comprising:

(a) two shaped halves, wherein each half has an inner surface, an outer surface, and a rim, and wherein said two shaped halves define an open internal space when in a closed position;

(b) first and second retainers molded on said inner surface of one of said shaped halves, each of said retainers comprising a first upstanding wall shaped to receive the bottle, a set of gripping projections extending from said first upstanding wall, and a second wall connecting the gripping projections;

wherein said gripping projections curve inwardly and are shaped to cradle the bottle between them, releasably securing the bottle and preventing the bottle from falling out of the container when said shaped halves are in an open position; and wherein each of the second walls has a top at a selected height extending from said inner surface adapted to receive the bottle so that when secured in the retainers the bottle is spaced from the shaped halves of the container in the closed position.

2. The injection molded container of claim 1, further comprising a living hinge that couples said two shaped halves, and permits said two shaped halves to move into said open position and said closed position.

3. The injection molded container of claim 2, further comprising a closure fastener disposed at an end of each shaped half that is opposite said living hinge, wherein said closure fastener secures said two shaped halves in said closed position along said rims.

4. The injection molded container of claim 1, wherein said two shaped halves are identically shaped.

5. The injection molded container of claim 1, wherein said first walls are molded to snugly fit the shape of top and bottom ends of the bottle respectively.

6. The injection molded container of claim 1, wherein each set of gripping projections is disposed at ends of a respective first upstanding wall.

7. The injection molded container of claim 1, wherein said two shaped halves each have two long sides and two short sides.

8. The injection molded container of claim 6, wherein said short sides oppose one another and said living hinge is disposed on one said short side of both shaped halves while said closure fastener is disposed on said opposing short side of both shaped halves.

9. The injection molded container of claim 1, wherein said rims of said shaped halves have a lip that engages the respective lip of said other shaped half, wherein said lips prevent said shaped halves from sliding against each other when in said closed position.

10. The injection molded container of claim 1, wherein the container is made of thermoplastic.

11. The injection molded container of claim 1, wherein said closure fastener comprises a locking extension on one of said shaped halves and a receiving cavity on said other shaped half, wherein the container is in said closed position when said locking extension engages said receiving cavity.

* * * * *